US006489709B1

(12) United States Patent
Teramura et al.

(10) Patent No.: US 6,489,709 B1
(45) Date of Patent: Dec. 3, 2002

(54) CAPTIVE SPARK PLUG GASKET

(75) Inventors: Hideki Teramura, Mie (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/531,602

(22) Filed: Mar. 20, 2000

(30) Foreign Application Priority Data

Mar. 19, 1999 (JP) ..... 11-075385

(51) Int. Cl.[7] ..... H01T 13/04

(52) U.S. Cl. ..... 313/140; 313/137; 313/135; 313/141; 313/142

(58) Field of Search ..... 313/140; 277/166, 277/11, 236

(56) References Cited

U.S. PATENT DOCUMENTS

| | | | | |
|---|---|---|---|---|
| 3,529,837 A | | 9/1970 | Eaton et al. | 227/26 |
| 3,879,043 A | | 4/1975 | Tozer | 277/163 |
| 3,948,532 A | | 4/1976 | Hopp | 277/9.5 |
| 4,168,839 A | | 9/1979 | Hopp et al. | 277/166 |
| 4,989,557 A | | 2/1991 | Penney | 123/169 EL |
| 5,760,533 A | * | 6/1998 | Saiki et al. | 313/137 |

FOREIGN PATENT DOCUMENTS

| | | | |
|---|---|---|---|
| EP | 39 34 755 A1 | 4/1991 | F16J/15/08 |
| GB | 2079873 B | 12/1983 | F16J/15/08 |
| GB | 2 308 869 A | 7/1997 | F16J/15/02 |
| JP | 47-10555 | 5/1972 | |
| JP | 57-17589 | 1/1982 | H01T/13/08 |
| JP | 4-228876 | 8/1992 | F02P/13/00 |
| JP | 6-283249 | 10/1994 | H01T/13/08 |
| JP | 6-302371 | 10/1994 | H01T/13/08 |
| JP | 7-19637 | 3/1995 | H01T/13/02 |
| JP | 9-219272 | 8/1997 | H01T/13/08 |
| JP | 11-13613 | 1/1999 | F02P/13/00 |

* cited by examiner

*Primary Examiner*—Vip Patel
*Assistant Examiner*—Kenneth A Berck
(74) *Attorney, Agent, or Firm*—Sughrue Mion, PLLC

(57) ABSTRACT

A gasket for a threaded element such as a spark plug to be screwed into a threaded hole of a support such as a cylinder head is provided. The threaded element has a threaded portion and an annular seat portion. The gasket is installed on the threaded element and compressed between the seat portion and an outer surface of the support around a threaded hole, when the threaded element is screwed into the threaded hole, to provide a seal between the threaded portion and the threaded hole. The gasket is formed from an annular sheet metal and in the form of an annular strip of a cross section including a plurality of bent portions. The cross section is made by a plane including a center axis of the gasket and of a such a bent shape as to enable an imaginary reference line which is located on the above described plane and parallel with the center axis, to cross at least three portions of the cross section. The initial axial size of the gasket, i.e., the height of the gasket before the gasket is compressed, is at least 2.5 mm. When pressure within a proper pressure range is applied to the gasket, i.e., within a proper pressure range from 6 to 12 kgf/mm$^2$, a variation $\Delta\alpha$ of compressive deformation $\alpha$ of the gasket corresponding to advance or axial movement of the threaded element by at least 0.5 pitch of the thread, i.e., corresponding to movement of the threaded element resulting from at least 0.5 turn is retained.

19 Claims, 14 Drawing Sheets

CAPTIVE SPARK PLUG GASKET

BACKGROUND OF THE INVENTION

1. Field of the Invention

The present invention relates in general to spark plugs for internal combustion engines and more particularly to captive spark plug gaskets.

2. Description of the Related Art

A spark plug has a metal shell. The metal shell has a threaded portion for securing the spark plug to a cylinder head of an engine. The spark plug is generally provided with an annular gasket which is so-called a captive spark plug gasket. The gasket is generally formed from an annular metal sheet by bending the metal sheet radially thereof. The gasket is mounted on the metal shell at a location adjacent an inner end of the threaded portion. At a location adjacent the inner end of the threaded portion, the metal shell has a flanged, seat portion. When the threaded portion is screwed into a threaded hole of the cylinder head to cause the gasket to be compressed between the seat portion and the outer surface of the cylinder head around the threaded hole, the gasket provides a seal between the outer surface of the cylinder head around the threaded hole and the seat portion of the metal shell for thereby providing a seal between the threaded portion of the metal shell and the threaded hole.

In this connection, to attain a seal by means of the gasket, it is important to control the tightening torque for screwing the treaded portion into the threaded hole so that a proper compressive force is applied to the gasket. To this end, for each type of spark plug, a recommended tightening torque range for attaining a good seal is fixed. FIG. 14 shows a relation between tightening torque and compressive deformation $\alpha$ of gasket due to advance or axial movement of the threaded portion, which is exhibited by a prior art gasket. The prior art gasket heretofore used causes, at the initial state of deformation, the compressive force to concentrate at a bent portion or portions thereof and is thus compressed and deformed considerably even when the compressive force is still within a relatively low range and tightening of the spark plug is still at the initial stage. In such a low range, a tightening force necessary for attaining a desired seal can be hardly obtained.

However, when the deformation proceeds further to make smaller the space for allowing further deformation, a larger compressive force is necessitated for further compressive deformation, thus causing the tightening torque to increase abruptly. As shown in FIG. 14, in case of the prior art gasket, the recommended tightening torque range for the spark plug, which is indicated by the hatched area, is located on a sharply sloped line portion of the graph where the tightening torque increases sharply or abruptly with increase of deformation. From this, it will be understood that the gasket deformation $\alpha$ range capable of attaining the recommended tightening torque range is quite narrow.

SUMMARY OF THE INVENTION

In recent automotive engines, the lean air-fuel mixture is used increasingly as the restriction on the exhaust emission control becomes severer (i.e., so-called lean-burn engines are used increasingly). As shown in FIG. 13, since the lean mixture is low in the ratio of fuel mixed, misfire may possibly be caused in case the mixture is introduced into the combustion chamber K in a certain direction (or in case the intake valve is disposed in a certain position) to cause the flow of the mixture into the spark gap g between the center electrode 203 and the ground electrode 204 to be obstructed by the ground electrode 204. For this reason, this kind of engine generally takes instructions that the threaded portion 201*a* of the metal shell 201 of the spark plug 200 is screwed into the threaded hole S1 of the cylinder head SH so as to orient the ground electrode 204 to optimize ignition.

However, when the threaded portion 201*a* is screwed into the threaded hole S1 to such an extend as to attain a desired seal, the ground electrode 204 is not always oriented to optimize ignition. In this connection, if the threaded portion 201*a* is tightened further or loosened so as to adjust the orientation of the ground electrode 204, the tightening torque changes to be out of the above described recommended limits since the gasket deformation $\alpha$ range capable of attaining the recommended tightening torque is so narrow. For example, when further tightening causes the tightening torque to become larger beyond the upper limit of the recommended tightening torque range, there is a possibility that the gasket 206 and/or the threaded portion 201*a* of the metal shell 201 is damaged to deteriorate the seal, and in the worst case, part of the metal shell is twisted off from the remaining section. On the contrary, when the threaded portion 201*a* is loosened to cause the tightening torque to become smaller than the lower limit of the recommended range, a desired seal cannot be obtained, thus leading to a trouble of leakage of gas or the like. In the meantime, indicated by reference numeral 202 is an insulator.

It has been proposed, as for example disclosed in Japanese Patent Provisional Publication No. 11-13613, to enable the ground electrode 204 to be oriented to optimize ignition, even if the recommended torque range is so narrow, by making the positional relation between a starting end of the thread of the threaded portion 201*a* and the ground electrode 204 constant. However, this method requires positioning of the ground electrode 204 with respect to the starting end of the thread of the threaded portion 201*a,* thus requiring much labor and longer working time and therefore causing lowered manufacturing efficiency and increased cost.

It is accordingly an object of the present invention to provide a gasket for a threaded element such as a spark plug, which enables to adjust the orientation or circumferential location of a certain reference part of a threaded portion of the threaded element within wide limits, under the condition where a suitable tightening torque is maintained, and accordingly which enables to adjust the orientation of a ground electrode of a spark plug relative to a cylinder head with ease and without causing any problem.

It is a further object of the present invention to provide a spark plug or the like threaded element with a captive gasket of the foregoing character.

To accomplish the above objects, there is provided according to an aspect of the present invention a gasket for a threaded element to be screwed into a threaded hole of a support. The threaded element has a threaded portion and an annular seat portion. The gasket is adapted to be installed on the threaded element and compressed between the seat portion and an outer surface of the support around the threaded hole, when the threaded element is screwed into the threaded hole, to provide a seal between the threaded hole and the seat portion. The gasket is formed from an annular sheet material and in the form of an annular strip of a cross section including a plurality of bent portions. The cross section is made by a plane including a center axis of the gasket and of a such a bent shape as to enable an imaginary reference line which is located on the plane and parallel with the center axis, to cross at least three portions of the cross section. An initial axial size of the gasket is at least 2.5 mm.

The structure for enabling the reference line parallel to the center axis to cross at least two portions of the cross section, means that, when a gasket 70 shown in FIG. 2 is taken as an example and reference is also made to FIG. 12A, the cross section is so shaped as to extend from a portion Sg1 crossed by the reference line PB to another portion Sg2 crossed by the reference line PB by way of a turnaround portion DC1. When the gasket 70 is deformed yieldingly or plastically in the direction of the center axis O, its deformation is mainly caused by buckling of the above described turnaround portion DC1. The structure for enabling the reference line PB to cross at least three portions of the cross section, means that such a cross section has at least two turnaround portions. Based on the above structure, it was discovered by the applicants that to set the initial axial size (i.e., the height of the gasket before the gasket 70 is compressed and hereinafter also referred to simply as height) of the gasket 70 to at least 2.5 mm makes it possible to adjust the circumferential location (or angular position) of a certain reference part of the threaded portion within relatively wide limits, under the condition where a proper compressive or tightening force is held applied to the gasket 70. The present invention is made based on such a discovery.

The reason why the above described effect can be produced by the present invention is considered as follows. Firstly, at the initial stage of compression, the respective turnaround portions resiliently deformed so that the stress increases relatively sharply with increase of deformation (first stage). When the applied pressure reaches to a certain level, bucking of the turnaround portions accompanied by plastic deformation starts, thus causing the rate of increase of pressure relative to increase of deformation to become more gradual (second stage). According to the present invention, the height of the gasket is set to at least 2.5 mm. By this, the portions of the gasket, by which the above described buckling is mainly caused, have the total length larger than that of the prior art gasket and constituted by at least two turnaround portions which are disposed separately. Thus, the pressure produced at the second stage where the circumferential location of a certain reference part of the threaded portion can be adjusted within relatively wide limits, can be increased up to such a level as to enable a proper compressive or tightening force to be applied to the gasket.

In the meantime, when the height of the gasket is smaller than 2.5 mm, it is difficult to make adjustment of the circumferential location of a certain reference part of the threaded portion within wide limits. On the other hand, in case, for example, the gasket is applied to a spark plug, it is necessary to set the upper limit of the height of the gasket so that the gasket does not interfere with the circumferential periphery of the countersink of the support (i.e., cylinder head) when deformed yieldingly or plastically to increase in outer diameter. Although the upper limit value varies depending upon a variation of the width of the gasket before the gasket is deformed, it is preferable to set the height of the gasket within the range equal to or smaller than 4.5 mm. In the meantime, it is more preferable to set the height of the gasket within the range from 2.7 to 3.5 mm.

According to another aspect of the present invention, assuming that the pressure P applied to the gasket is expressed by $P=F/\{\pi(R1^2-R2^2)\}$ where R1 is ½ of the initial outer diameter of the gasket, R2 is ½ of the initial inner diameter of the gasket and F is a compressive force applied to the gasket, a variation $\Delta\alpha$ of compressive deformation $\alpha$ of the gasket in response to a variation of the pressure P within the range from 6 to 12 kgf/mm$^2$ is at least 0.5 mm.

In the above structure, the pressure range wherein a proper compressive force is applied to the gasket (hereinafter referred to as a proper pressure range) is determined so as to be from 6 to 12 kgf/mm$^2$. The gasket is constructed so that a variation $\Delta\alpha$ of compressive deformation $\alpha$ of the gasket in response to a variation of the pressure P within the range from 6 to 12 kgf/mm$^2$ is at least 0.5 mm, whereby it becomes possible to adjust the orientation or circumferential location of a certain reference part of the threaded portion within relatively wide limits.

An example of the thread element which the gasket of this invention is particularly effectively used with, is a spark plug for an internal combustion engine such as an automotive engine. The spark plug includes a center electrode, an insulator surrounding the center electrode, a tubular metal shell mounted on the insulator and having a threaded portion, and a ground electrode connected to the shell and spaced apart from the center electrode so as to provide a spark gap therebetween. In this instance, the metal shell has the threaded portion and a seat portion on the outer periphery thereof.

When the gasket of this invention is applied to a spark plug, it can produce the following effects. As described above, for the purpose of improving the assuredness with which the air-fuel mixture is ignited by the spark plug, the orientation of a certain reference part of the threaded portion when screwing of the threaded portion into the threaded hole is finished, is instructed in many lean-burn engines so that the ground electrode is oriented to optimize ignition. In this instance, the gaskets usually vary in size and material to some extent and the positional relationship between the starting end of the thread of the threaded portion and the ground electrode is not constant. For this reason, there can possibly occur such a case in which when the threaded portion is screwed into the threaded hole until the pressure on the gasket (i.e., tightening torque) reaches a predetermined, target value, the ground electrode is not always oriented to optimize ignition but is largely displaced from the target circumferential location.

However, the gasket of the present invention is constructed so that a variation $\Delta\alpha$ of compressive deformation $\alpha$ of the gasket in response to a variation of the pressure P within the above described proper pressure range wherein a proper compressive force is applied to the gasket is at least 0.5 mm and the range of turn of the thread corresponding to the variation $\Delta\alpha$ is wide. As a result, it becomes possible to turn the threaded portion within relatively wide limits, under the condition where a proper compressive force on the gasket is retained, thus making it possible to attain desired adjustment of the circumferential location of a certain reference part of the threaded portion, i.e., desired adjustment of the orientation of the ground electrode without causing any problem. Thus, the gasket of this invention can dispense with the control of the positional relationship between the starting end of the thread of the threaded portion and the ground electrode, so there is not any possibility of causing such lowered production efficiency as is caused by the prior art disclosed in Japanese Patent Provisional Publication No. 11-13613.

In this instance, it is preferable that the variation $\Delta\alpha$ of compressive deformation $\alpha$ of the gasket in response to a variation of the above described proper pressure range wherein the pressure P on the gasket ranges from 6 to 12 kgf/mm$^2$ is of the length corresponding to at least 0.5 pitch of the thread of the threaded portion, i.e., of such a length as to allow the threaded portion to advance or axially move at least 0.5 pitch. This means that the threaded potion can be rotated by at least 0.5 turn within the pressure range in which a proper compressive force is applied to the gasket. Accordingly, adjustment of the circumferential location of a certain reference part of the threaded portion relative to the cylinder head can be made by rotating the threaded portion by 0.5 turn or more, i.e., within wide limits. In the meantime, the variation $\Delta\alpha$ of compressive deformation $\alpha$ is preferably of the length corresponding to at least one-pitch of the thread.

DESCRIPTION OF THE PREFERRED EMBODIMENTS

Figure 1:
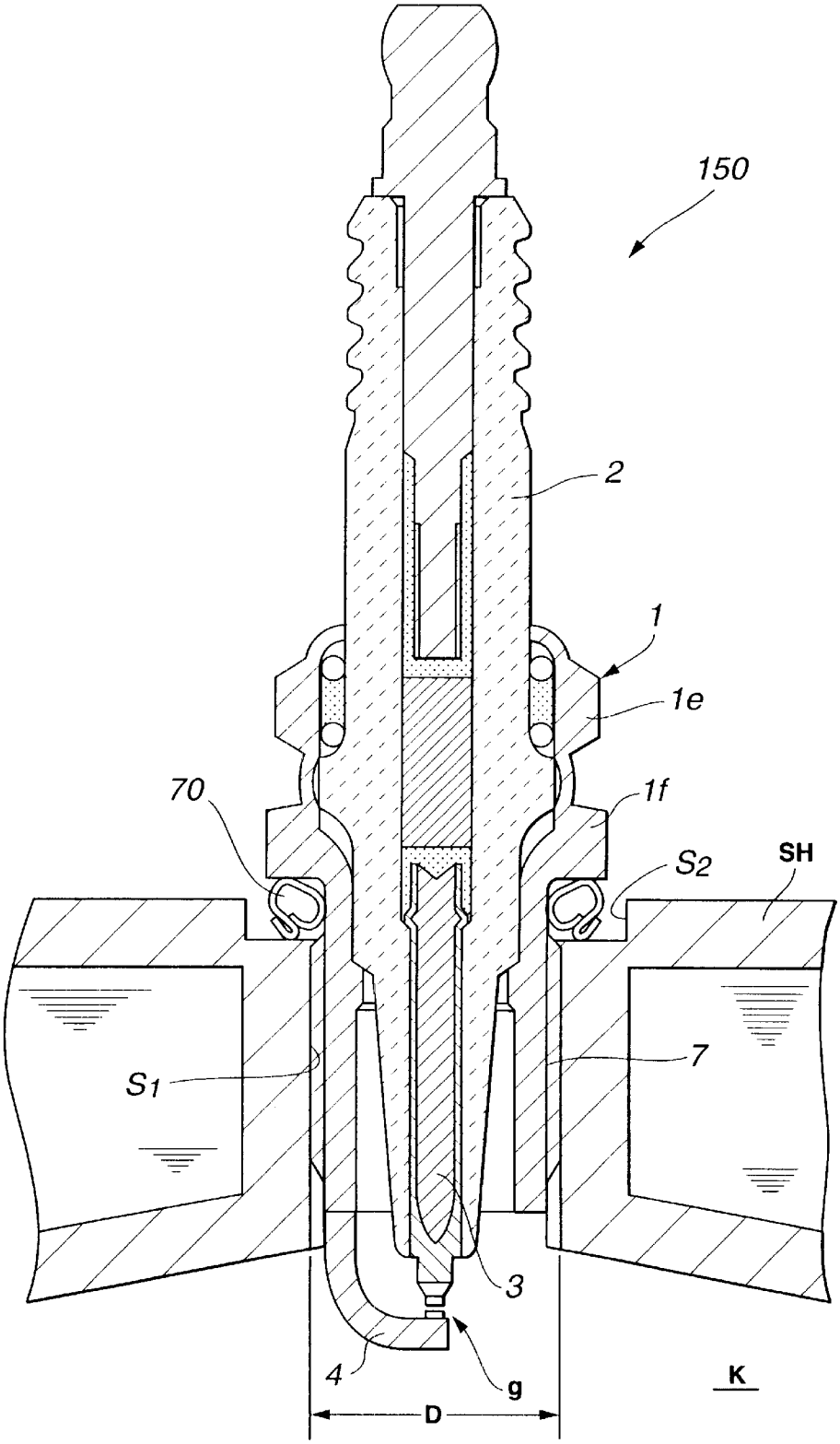
FIG. 1 is a longitudinal sectional view of a spark plug with a captive gasket according to an embodiment of the present invention.

Referring to FIG. 1, a spark plug with a captive gasket according to an embodiment of the present invention is generally indicated by 150 and shown in a state of being installed on a cylinder head SH of an internal combustion engine. The spark plug 150 includes a tubular, metal shell 1, an insulator 2 fitted in the metal shell 1, a center electrode 3 disposed inside the insulator 2, a ground electrode 4 welded or otherwise secured at an end to the metal shell 1. The ground electrode 4 is adapted to be spaced from the center electrode 3 to provide a spark gap g therebetween.

The metal shell 1 has a threaded portion 7 at an outer circumferential periphery thereof. At an inner end of the threaded portion 7, the metal shell 1 has a seat portion (i.e., gasket retaining portion) 1f in the form of a radially outward flange. The outer diameter of the threaded portion 7 is equal to or smaller than 18 mm (for example, 18 mm, 14 mm, 12 mm or 10 mm). In the meantime, indicated by 1*e* is a tool engaging portion of the metal shell 1, which is hexagonal in cross section and with which a tool such as a wrench is engaged. The spark plug 150 is secured to a cylinder head SH by screwing the threaded portion 7 into a threaded hole S1 and adapted to ignite the air-fuel mixture supplied to a combustion chamber K. A gasket 70 according to an embodiment of the present invention is mounted on the metal shell 1 at a location adjacent the inner end of the threaded portion 7. In FIG. 1, the gasket 70 is shown in the state before being compressed.

Figure 2A:
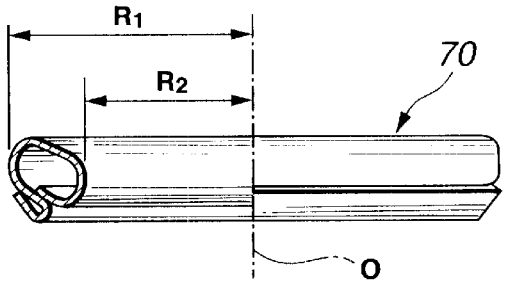
FIG. 2A is an enlarged side elevational and half sectional view of the gasket of FIG. 1.
Figure 2B:
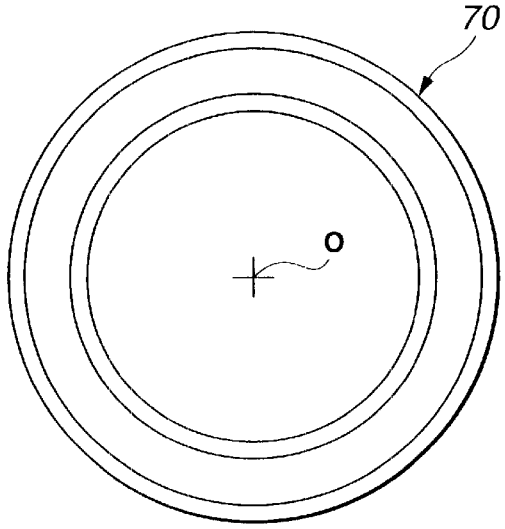
FIG. 2B is a plan view of the gasket of FIG. 2A.
Figure 2C:
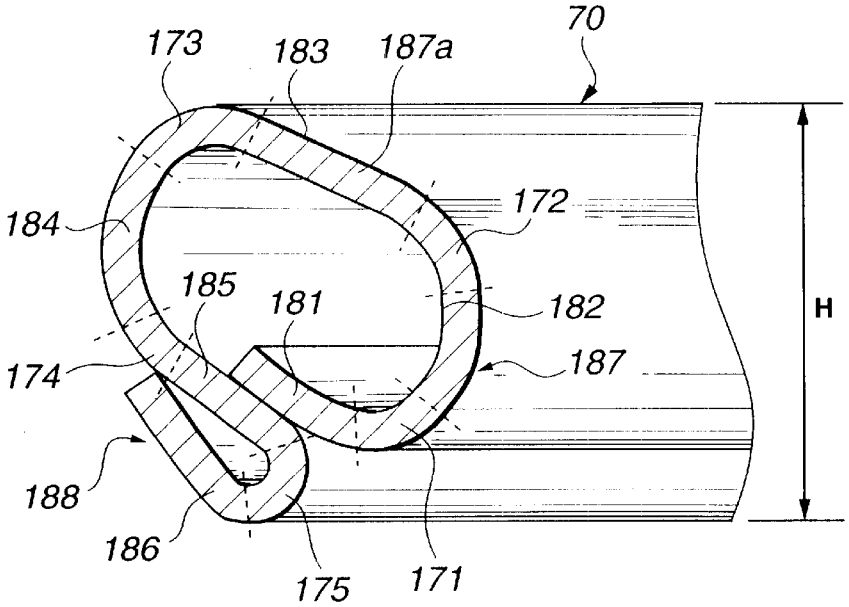
FIG. 2C is an enlarged, fragmentary sectional view of the gasket of FIG. 2A.
Figure 3A:
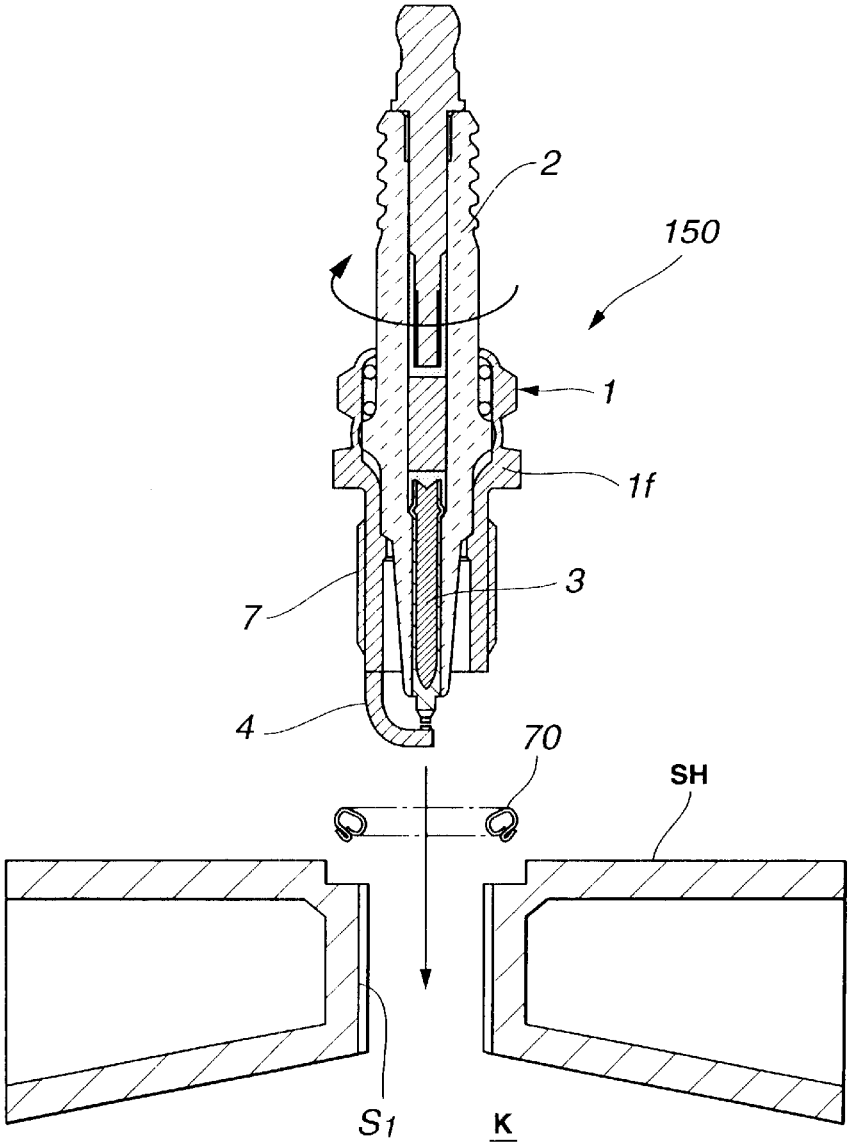
FIGS. 3A and 3B are views for illustrating the method of attaching the spark plug and gasket to a cylinder head.

Referring now to FIGS. 2A to 2C, the gasket 70 is formed from an annular metal sheet and in the form of an annular or ring-shaped strip of a cross section including a plurality of bent portions. The cross section is made by a plane including a center axis O of the gasket 70. As seen from FIG. 3A, by allowing the outer end of the threaded portion 7 to pass through the gasket 70, the gasket 70 is mounted on the metal shell 1 at a location adjacent the inner end of the threaded portion 7 so as to be disposed concentrically with the seat portion 1*f*. The threaded portion 7 is screwed into the threaded hole S1 and tightened. By this, as shown in FIG. 4C, the gasket 70 is compressed axially between the seat portion 1f and the cylinder head outer surface SH surrounding the threaded hole S1 to provide a seal between the threaded hole S1 and the threaded portion 7.

When an axial compressive force is applied to the gasket 70, bending proceeds in at least one of the radially bent portions, so that the gasket 70 is deformed compressively in such a manner as to cause the both sides of the bent portion to come nearer axially of the gasket 70. By the resilient restoring force accompanied by the compressive deformation, the abutment surfaces of the gasket 70 are caused to fittingly contact the seat portion If and the cylinder head outer surface SH surrounding the threaded hole S1 for providing a seal between them.

As shown in FIG. 2C, the gasket 70 is formed with first to fifth bent portions 171 to 175 which are arranged in this order from the radially inner end to the radially outer end of a ring-shaped metal sheet. The first to fourth bent portions 171 to 174 are bent or curved in the same direction, i.e., counterclockwise, and the fifth bent portion 175 is bent or curved in the direction opposite to that of the first to fourth bent portions 171 to 174, i.e., clockwise, when the first to fifth bent portions 171 to 175 are observed in this order. By these bent portions 171 to 175, the gasket 70 can be separated into first to sixth constituent sections 181 to 186. Of these constituent sections, the third constituent section 183 located between the second and third bent portions 172 and 173 has a flat or planar outer side surface which constitutes a sealing surface for contact with the seat portion if (refer to FIG. 1). Further, the first to fifth constituent sections 181 to 185 are adapted to constitute a first baggy portion 187 bulging out radially inward of the gasket 70. In the first baggy portion 187, the second constituent section 182 and the fourth constituent section 184 stand upright in the direction parallel to the center axis of the gasket 70, i.e., axially of the gasket 70, and constitute a pair of radially opposed wall portions. On the other hand, the fifth constituent section 185 and the sixth constituent section 186 are adapted to constitute a second baggy portion 188 which is hairpin-shaped and which constitutes a radially outer, axially lower end portion of the gasket 70, so that the second baggy portion 188 is formed at the outer periphery of the first baggy portion 187 in such a manner as to have the fifth constituent section 185 in common with the first baggy portion 187. As shown in FIG. 4B, the outer surface side of the sixth constituent section 186 or the fifth bent portion 175, when the gasket 70 is in a compressed and deformed state, is adapted to constitute a sealing surface for contact with the cylinder head outer surface SH around the threaded hole S1. In the meantime, there may occur such a case the radially inner, axially lower end portion of the first baggy portion 187 also constitutes a sealing surface.

In this embodiment, the radius of curvature of each of the bent potions is set relatively large so that a cross section of a tubular band constituting the gasket 70 is generally rounded, and the contact surface 187*a* for contact with the seat portion if is a little inclined in a way as to descend radially inward of the gasket 70. By this, the gasket 70 is brought into line contact, at a portion adjacent the radially outer end of the contact surface 187*a*, with the seat portion 1*f*, thus making it possible to attain an improved sealing ability.

Figure 12A:
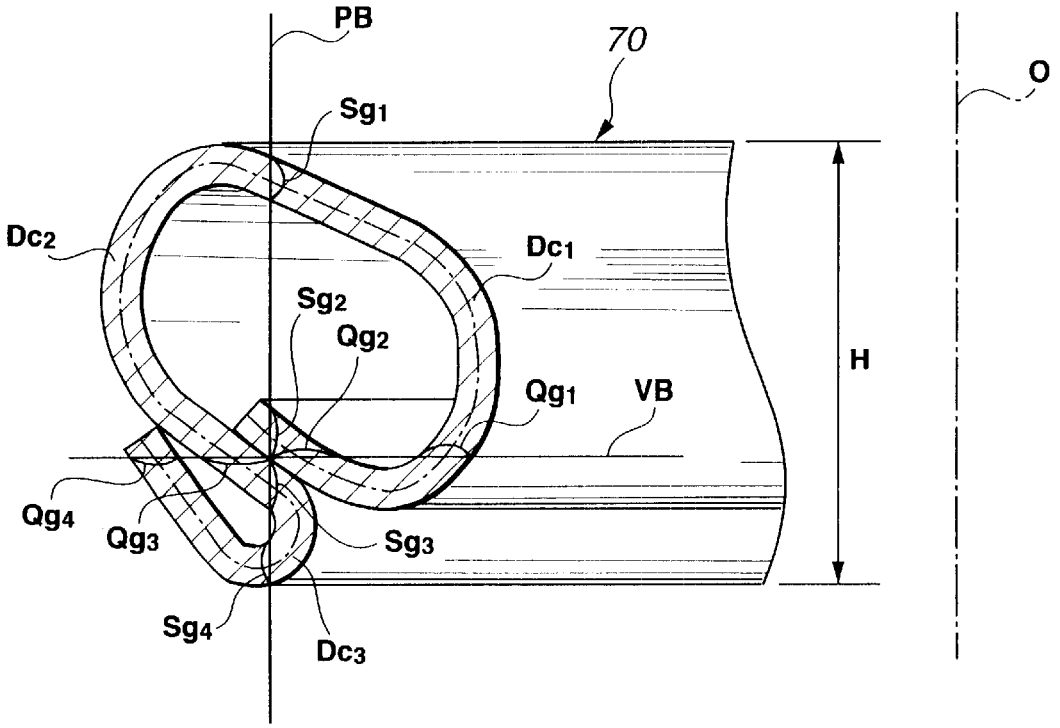
FIG. 12A is a view similar to FIG. 2C but illustrates the gasket in relation to a reference line parallel to a center axis and a reference line perpendicular to the center axis.
Figure 12B:
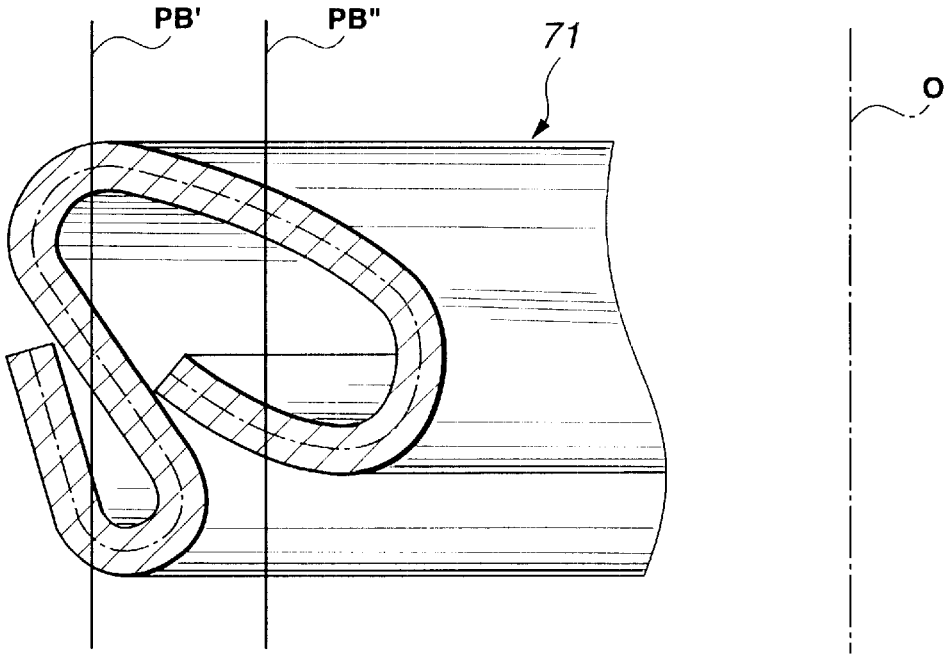
FIG. 12B is a view similar to FIG. 12A but shows a further variant of the gasket of FIG. 1.
Figure 13:
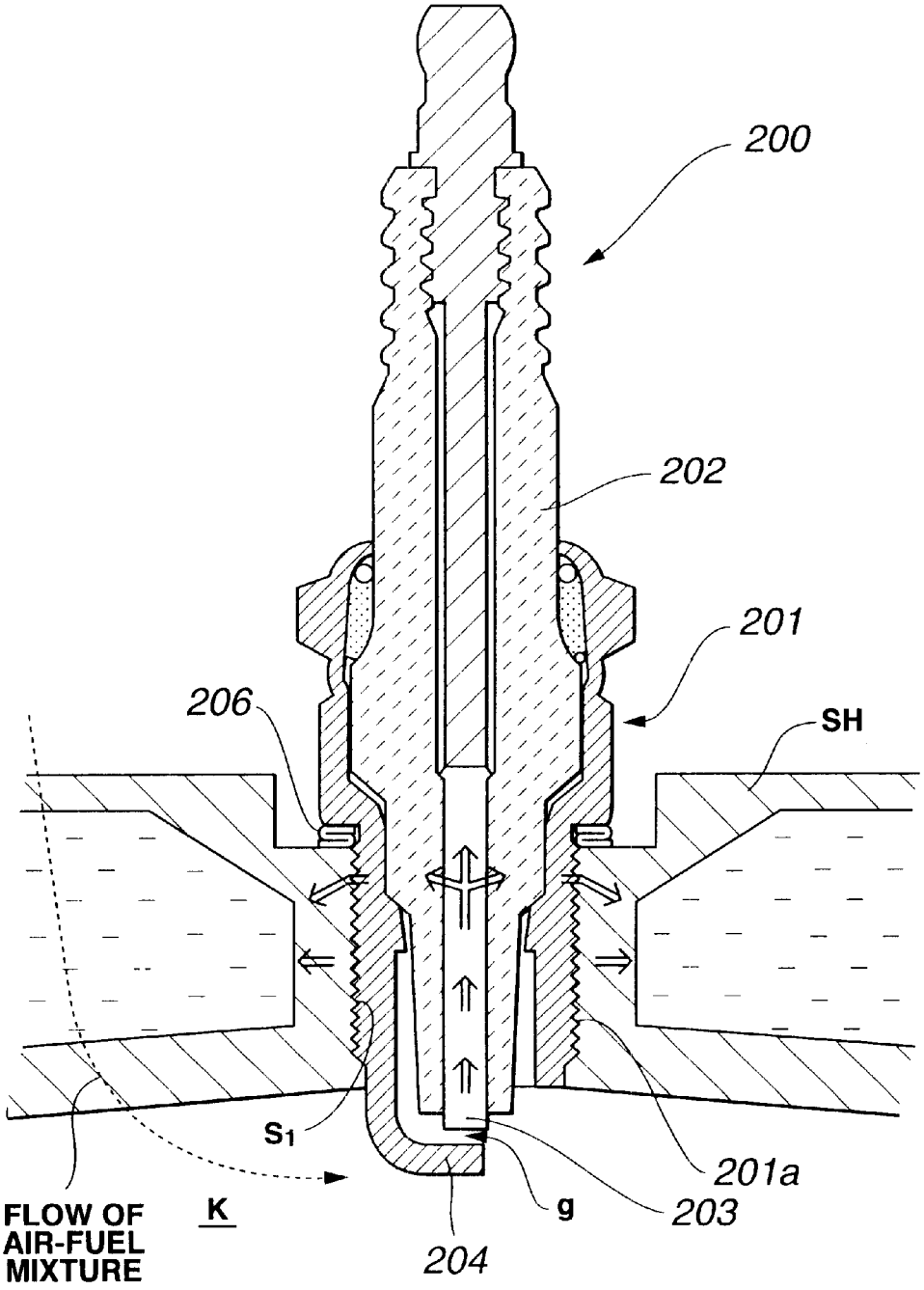
FIG.13 (PRIOR ART)
FIG. 13 is a longitudinal sectional view of a spark plug with a prior art gasket.
Figure 14:
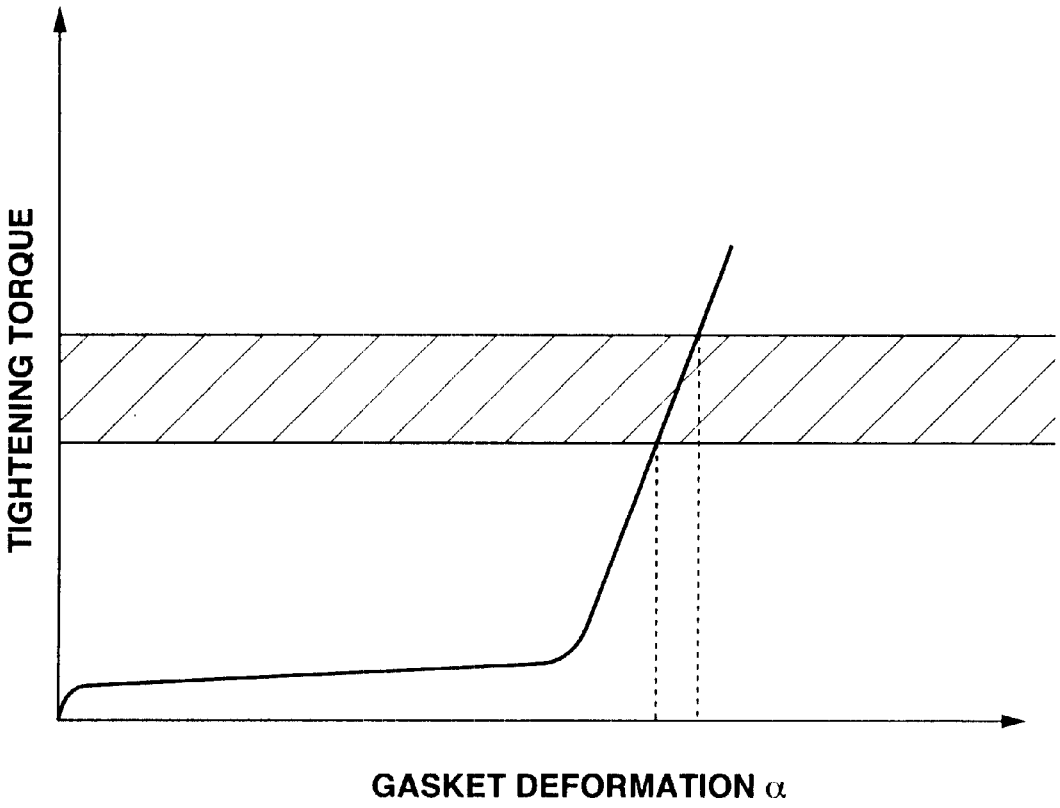
FIG.14 (PRIOR ART)
FIG. 14 is a graph of a relation between applied pressure and resulting deformation with respect to the prior art gasket of FIG. 13.

As shown in FIG. 12A, the cross section of the gasket 70, which is made by a plane including the center axis O of the gasket 70, is so shaped as to enable an imaginary parallel reference line PB which is located on the plane and parallel with the center axis O of the gasket 70, to cross at least three portions of the cross section, i.e., four portions Sg1–Sg4 in this embodiment. In this connection, it will suffice in the present invention that the parallel reference line PB can be positioned at any place so long as it crosses at least three portions of the cross section. In this connection, as the parallel reference lines PB' and PB" shown in FIG. 12B, the parallel reference lines can cross the different number of portions of the cross section depending upon the position where they are drawn. In the meantime, FIG. 12B shows a gasket 71 which is a variant of the gasket 70 of FIG. 2 which differs therefrom in that the fourth bent portion 174 is not provided, the curved fourth constituent section 184 is joined directly with the straight fifth constituent section 185, and the third bent portion 173 is bent a little more sharply.

The height H of the gasket 70 of FIGS. 2A to 2C, i.e., the initial axial size before the gasket 70 is compressed, is adjusted so as to range from 2.5 mm to 4.5 mm and preferably from 2.7 mm to 3.5 mm.

Figure 4A:
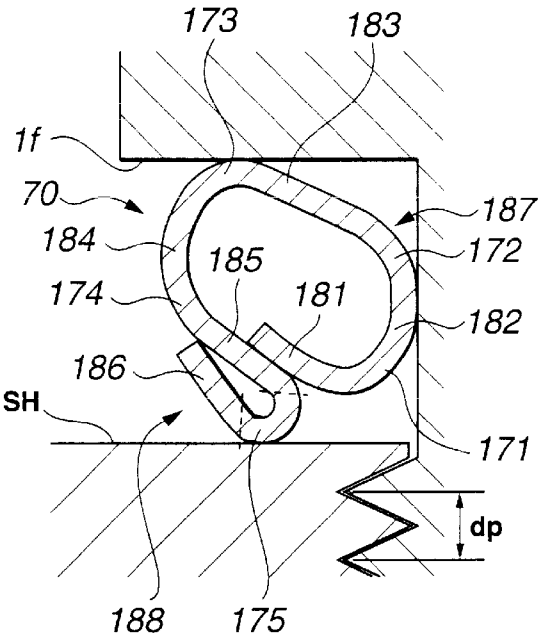
FIGS. 4A to 4C are views for illustrating presumed deformation stages of the gasket of FIG. 1.
Figure 4B:
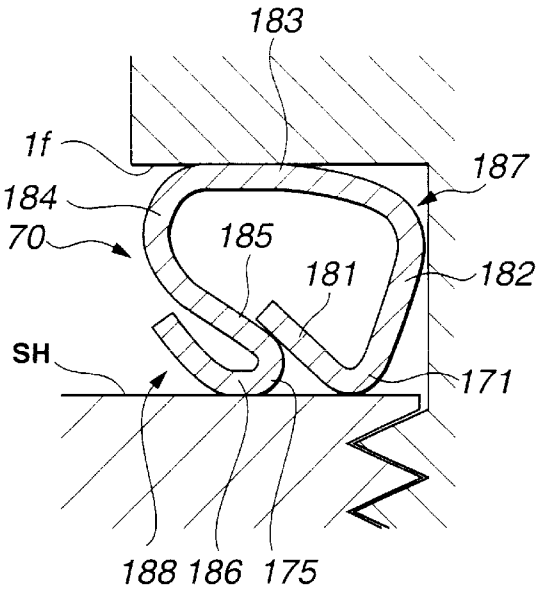
Figure 4C:
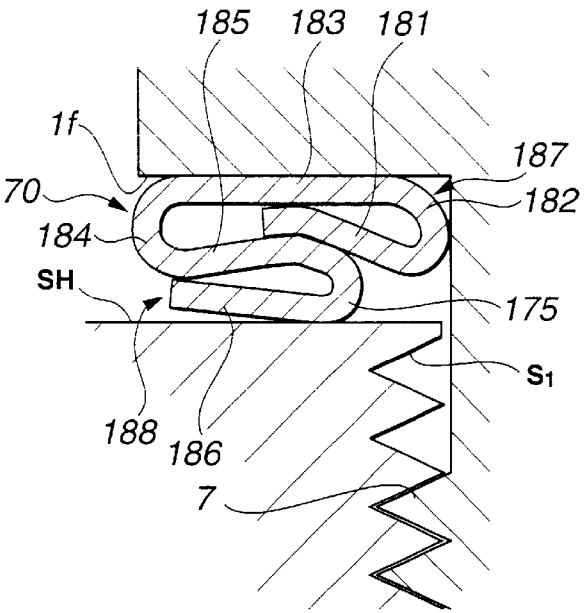
Figure 5:
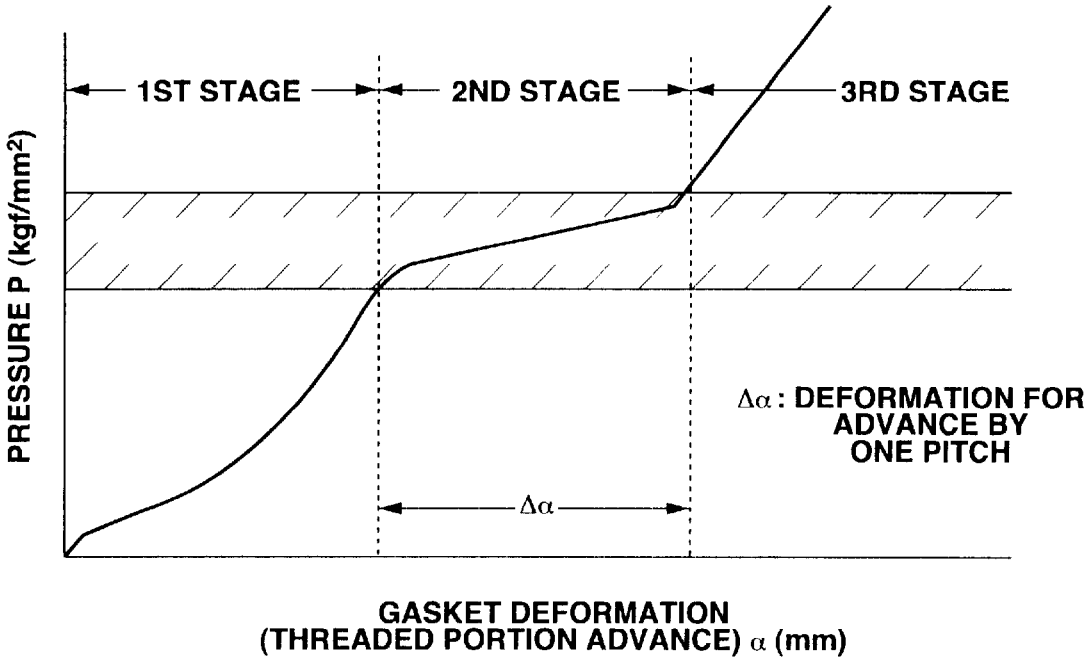
FIG. 5 is a graph of a relation between applied pressure and resulting deformation of gasket.

When the spark plug 150 is screwed into the threaded hole S1, it is assumed that the gasket 70 causes such deformations as shown in FIGS. 4A to 4C. Firstly, at an initial state of deformation, the first constituent section 181 is pushed upward by the second baggy portion 188, thus allowing the deformation to proceed in such a manner as to mainly reduce the angle of the first bent portion 171. By this, as shown in FIG. 4B, the second baggy portion 188 and the first baggy portion 187 are brought into contact, at the respective lower ends thereof, with the cylinder head outer surface SH around the threaded hole S1. Henceforth deformation of the gasket 70 will be described with additional reference to the graph of FIG. 5. The second constituent section 182 and the fourth constituent section 184 constituting the inner and outer circumferential walls of the gasket 70 (these sections constitute major parts of turnaround portions DC1 and DC2 shown in FIG. 12A), are adapted to deform mainly resiliently, thus causing the pressure P on the gasket 70 (i.e., stress caused in the gasket) to increase relatively sharply with increase of the deformation of the gasket 70 (first stage). When the pressure P on the gasket 70 increases above a predetermined level, the second constituent section 182 and the fourth constituent section 184 start buckling and deforming plastically, thus causing the rate of increase of pressure P relative to increase of compressive deformation $\alpha$ of the gasket 70 to become smaller (second stage).

The gasket 70 is adapted such that assuming that the pressure P applied to the gasket 70 is expressed by $P=F/\{\pi(R1^2-R2^2)\}$ where 2R1 is the outer diameter of the gasket 70 shown in FIG. 2A at the initial stage, 2R2 is the inner diameter of the gasket 70 and F is a compressive load, the variation $\Delta\alpha$ of the compressive deformation $\alpha$ corresponding to the applied force P within the range from 6 to 12 $kgf/mm^2$ (proper pressure range corresponding to that of the second stage) can be at least 0.5 mm.

Further, when this is observed from the point of view of the pitch of the thread 7, the variation ha of the compressive deformation $\alpha$ corresponding to the above described proper pressure range can correspond to advance or axial movement of the threaded portion 7 by at least 0.5 pitch (preferably, at least one pitch). In the meantime, in FIG. 4A, the distance of advance by one pitch is indicated by dp. The distance dp is generally within the range from about 1.00 mm to about 1.25 mm.

The above described proper pressure range is determined on the basis of the recommended tightening torque range that enables to attain a good sealing ability when the spark plug 150 is screwed into the threaded hole S1 without causing any damage to the threaded portion 7, etc. More specifically, the proper pressure range is such that when the spark plug 150 is installed on the engine, loosening of the spark plug 150 due to vibrations or the like is never caused and deterioration of the sealing ability due to damage of the thread 7 or the like is never incurred. In the meantime, the recommended tightening torque of the spark plug 150 varies depending upon a variation of the outer diameter of the threaded potion 7. However, when the recommended tightening torque is converted to pressure, the pressure can be generally within the above described range independently of the size of the threaded portion 7. The specific recommended tightening torque per each diameter of thread is described, by way of example, as follows.

Diameter of thread 10 mm: 1.0 to 1.2 kgf·m

Diameter of thread 12 mm: 1.5 to 2.0 kgf·m

Diameter of thread 14 mm: 2.5 to 3.0 kgf·m

Diameter of thread 18 mm: 3.5 to 4.0 kgf·m

These recommended tightening torque ranges may possibly vary depending upon the surface condition of the gasket 70. For example, in case the surface of the gasket 70 in contact with the seat portion if (refer to FIG. 1) or the cylinder head outer surface SH around the threaded hole S1 has oil adhered thereto or its surface roughness is small, there is a possibility that the friction at the time of tightening is lowered so that the lower limit of the recommended tightening torque range can be lowered.

The operation of the above described gasket 70 will be described hereinlater.

Figure 3B:
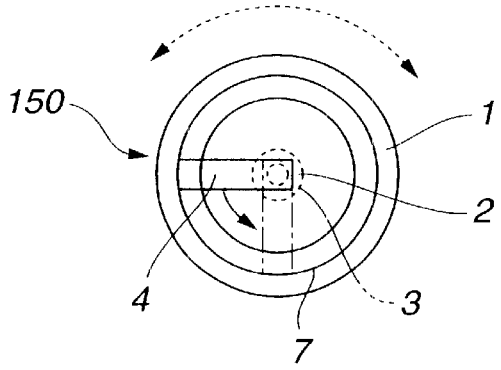

In case, for example in FIG. 1, the circumferential location of a certain reference part of the threaded portion 7 when screwing of the threaded portion 7 into the threaded hole S1 is finished, is instructed so that the ground electrode 4 is oriented to optimize ignition, it is necessitated to attain sufficiently large pressure on the gasket 70, simultaneously with positioning of the ground electrode 4. By the gasket 70, the variation $\Delta\alpha$ of compressive deformation $\alpha$ resulting within the range where a proper compressive or tightening force is applied to the gasket 70, can be at least 0.5 mm, so that the rotative limits of the threaded portion 7 corresponding to the variation $\Delta\alpha$ is so wide, i.e., at least 0.5 to 1.0 turn. As a result, as shown in FIG. 3B, the threaded portion 7 can be turned within relatively wide angular limits, under a condition where a proper compressive or tightening force is retained, thus making it possible to adjust the position or orientation of the ground electrode 4 without any problem.

In the meantime, with respect to the sectional view of FIG. 12 A, i.e., with respect to the sectional view of the gasket 70 which is made by a plane including the center axis O thereof, the gasket 70 is in the form of an annular strip of a cross section which is preferably so shaped as to enables an imaginary perpendicular reference line VB which is located on the above described plane and perpendicular to the center axis O, to cross at least two portions of the cross section (i.e., four portions Qg1–Qg4 in the embodiment of FIG. 12A). By this, the gasket portions which are contributive to buckling are formed in parallel in the radial direction of the gasket 70. This is convenient in making higher the pressure level at the second stage in the graph of FIG. 5 than that of the prior art gasket, and resultantly it becomes possible to attain the purpose of the present invention more easily, i.e., to retain the variation $\Delta\alpha$ of compressive deformation $\alpha$ resulting when the pressure on the gasket 70 is within a proper pressure range, is at least 0.5 mm.

Further, with respect to the feature that the variation $\Delta\alpha$ of compressive deformation $\alpha$ corresponding to the above described proper pressure range is held equal to or larger than the distance of advance of the threaded portion 7 by 0.5 pitch (preferably, by one pitch) of the thread, it is more preferable that the initial axial size of the gasket 70 (i.e., the height H) is determined so as to be larger than the length corresponding to two pitches of the thread.

On the other hand, in the spark plug 150 with the gasket 70 of the present invention, it is preferable that assuming that the diameter of the threaded portion 7 is indicated by D (mm), the initial inner diameter of the gasket 70 is 0.985D (mm) or more and the initial outer diameter is 1.45D (mm) or less, and assuming that the initial outer diameter of the gasket 70 is indicated by 2R1 (mm) and the initial inner diameter of same is indicated by 2R2 (mm), the gasket area S which is expressed by $S=\{\pi(R1^2-R2^2)\}$ is within the range from 8D to 10D ($mm^2$). When the initial inner diameter of the gasket 70 is smaller than 0.985D, attachment of the gasket 70 to the threaded portion 7 is difficult. Further, when the initial diameter exceeds 1.45D, there can possibly occur such a case in which, as shown in FIG. 1, the gasket 70 and the inner circumferential surface of the countersink S2 at the cylinder head outer surface SH around the threaded hole S1 interfere with each other to make attachment of the spark plug 150 difficult. Further, when the outer diameter of the gasket 70 is larger than that of the countersink S2, the gasket 70 may possibly lack its radial width, thus causing its sealing ability to become insufficient. On the contrary, when the gasket area S exceeds 10D, the radial width of the strip constricting the gasket 70 becomes excessively large, so attachment of the gasket 70 may possible become difficult.

Further, the sheet metal constituting the gasket 70 is preferably selected so as to meet with the following requirements.

(1) The material has a proper strength but can cause plastic deformation in response to compressive, relatively smoothly.

(2) The material enables manufacturing of the gasket 70 by pressing or the like manufacturing process with ease.

(3) The material has a good resistance to corrosion.

Such a material that can meet with the above requirements is, by way of example, austenitic stainless steels. For example, the following austenitic stainless steels which are defined by Japanese Industrial Standard can be enumerated (regarding the representative materials, the composition of the major components other than Fe are shown by wt. %): SUS201, SUS202, SUS301, SUS301J, SUS302, SUS302B, SUS304(Cr:18.0–20.0, Ni:8.0–10.5), SUS304L, SUS304N1, SUS304N2, SUS304LN, SUS305, SUS309S, SUS310S(Cr:24.0–26.0, Ni:19.0–22.0), SUS316 (Cr:16.0–18.0, Ni:10.0–14.0, Mo:2.5), SUS316L, SUS316N, SUS316LN, SUS316J1, SUS316J1L, SUS317, SUS317L, SUS317J1, SUS321, SUS347, and SUSXM15J1.

Further, when the above described austenitic stainless steels are used, it is desirable that the thickness of the metal sheet is within the range from 0.2 mm to 0.5 mm. When the thickness of the metal sheet is smaller than 0.2 mm, the gasket 70 will be compressed so much with relatively low pressure, thus causing a possibility that it becomes impossible to accomplish the purpose of this invention, i.e., to attain that the variation $\Delta\alpha$ of compressive deformation $\alpha$ resulting within the proper pressure range is at least 0.5 mm. On the other hand, when the thickness of the metal sheet exceeds 0.5 mm, the pressure necessary for causing compressive deformation of the gasket 70 becomes too high, thus causing a possibility that the thread of the threaded portion 7 is broken. In the meantime, as the material for the gasket 70, cold rolled steel plated with corrosion-resistant metal such as nickel and zinc can be used. Preferable cold rolled steel is SPCD or SPCE which is defined according to Japanese Industrial Standard (JISG3141) and which is 0.3 mm thick and 300 $N/mm^2$ in tensile strength.

In the meantime, in this embodiment, the diameter D of the thread of the threaded portion 7 in FIG. 1 is M14 and its pitch is 1.25 mm. The gasket 70 is constituted, as a whole, by SUS310S which is austenitic stainless steel (0.3 mm thick), 20.3 mm in outer diameter 2R1 (i.e., 1.45D since D=14 mm), 13.72 mm in inner diameter 2R2 (i.e., 0.985D since D=14 mm) and 3.1 mm in height (2.48 dp).

Hereinafter, several variants of the gasket 70 will be described.

Figure 6A:
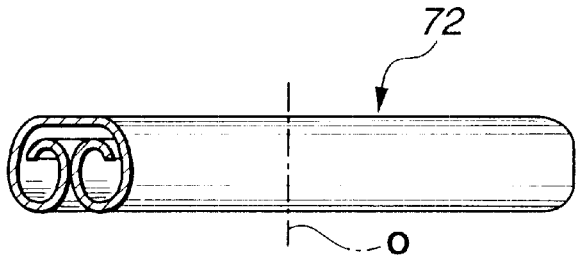
FIG. 6A is a view similar to FIG. 2A but shows a variant of the gasket of FIG. 1.
Figure 6B:
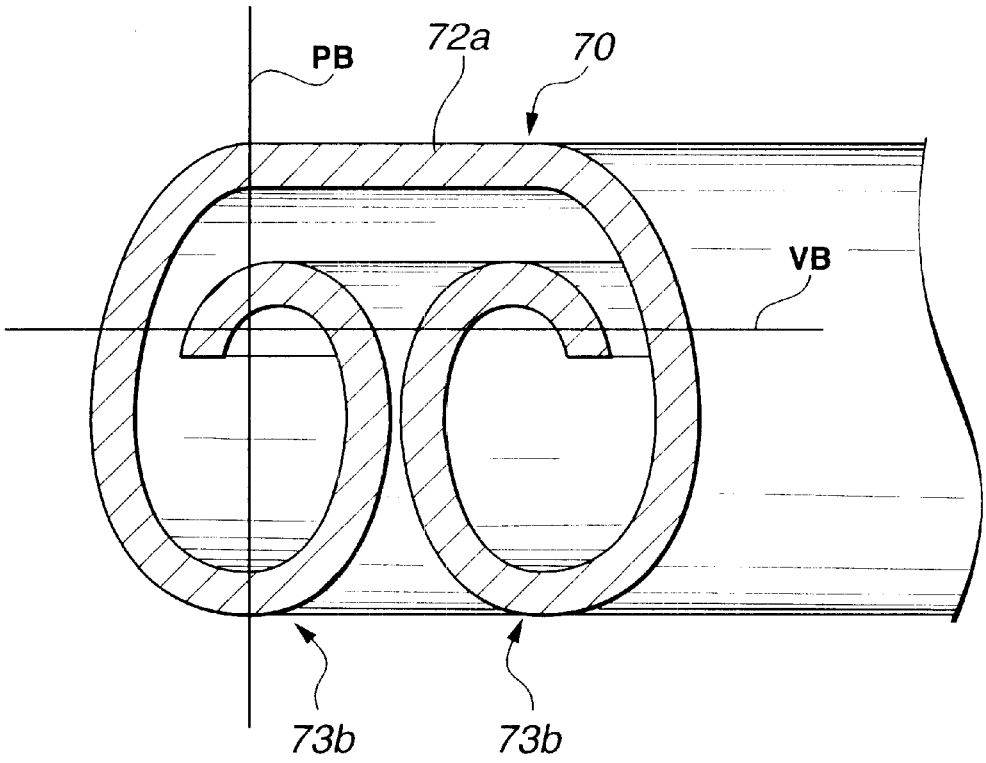
FIG. 6B is an enlarged fragmentary sectional view of the gasket of FIG. 6A.

FIGS. 6A and 6B show a gasket 72 according to a variant of this invention. The gasket 72 is in the form of an annular strip of a cross section having an abutment portion 72*a* for contact with the seat portion 1*f* of the spark plug 150 and a pair of baggy portions 72*b* and 72*b* at the radially opposite ends of the abutment portion 72*a*. The baggy portions 72*b* and 72*b* are formed by bending a pair of radially inner and outer peripheral portions of an annular metal sheet radially outward an d inward of the gasket 72, respectively. As shown in FIG. 6B, the gasket 72 is so shaped as to enable to draw a parallel reference line PB and perpendicular reference line VB which can meet with the above described requirements. By the two baggy portions 72*b* and 72*b*, the gasket 72 can provide an improved seal between the seat potion if of the spark plug 150 and the outer surface of the cylinder head SH around the threaded hole S1.

Figure 7A:
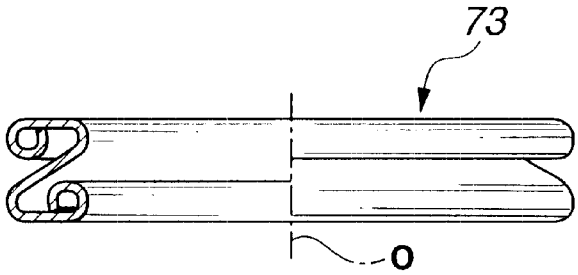
FIG. 7A is a view similar to FIG. 2A but shows a further variant of the gasket of FIG. 1.
Figure 7B:
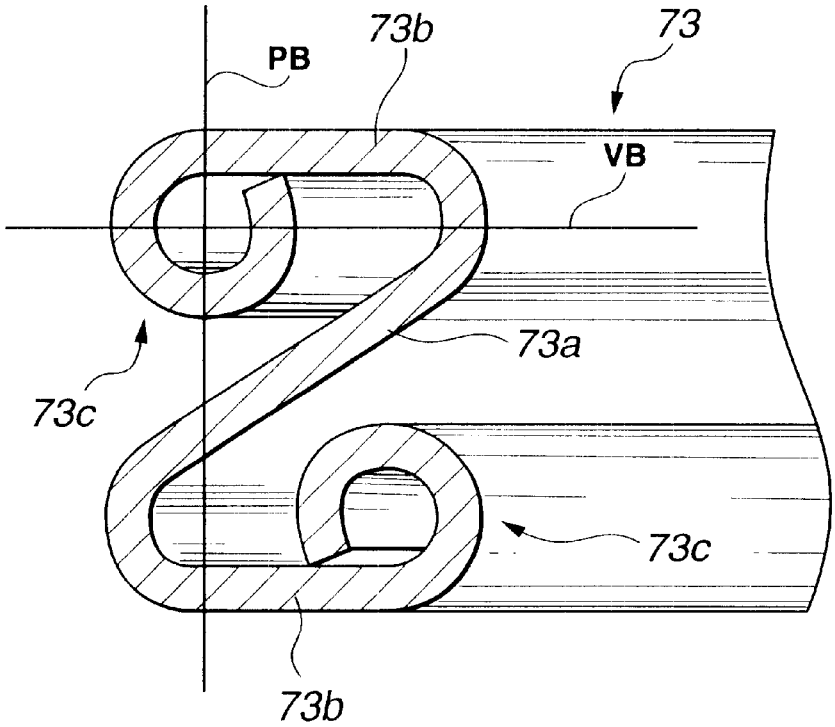
FIG. 7B is an enlarged fragmentary sectional view of the gasket of FIG. 7A.

FIGS. 7A and 7B show a gasket 73 according to a further variant of the present invention. The gasket 73 is in the form of an annular strip of a Z-shaped cross section having a slanted, straight main body portion 73*a* which is formed by a portion of an annular sheet metal intermediate between the radially inner and outer peripheral ends thereof. The cross section further has on the opposite ends of the main body portion 73*a*, a pair of abutment portions 73*b* and 73*b* for contact with the seat portion 1*f* of the spark plug 150 and the support surface of the cylinder head SH around the threaded hole S1, respectively and a pair of radially inner and outer end portions which are bend inward of the gasket 73 so as to form a pair of baggy portions 73*c* and 73*c*. As shown in FIG. 7B, the gasket 73 is so shaped as to enable to draw a parallel reference line PB and perpendicular reference line VB which can meet with the above described requirements.

Figure 8A:
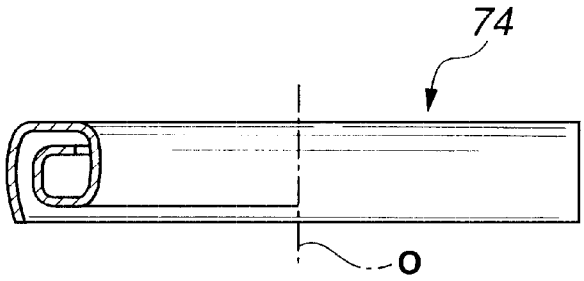
FIG. 8A is a view similar to FIG. 2A but shows a further variant of the gasket of FIG. 1.
Figure 8B:
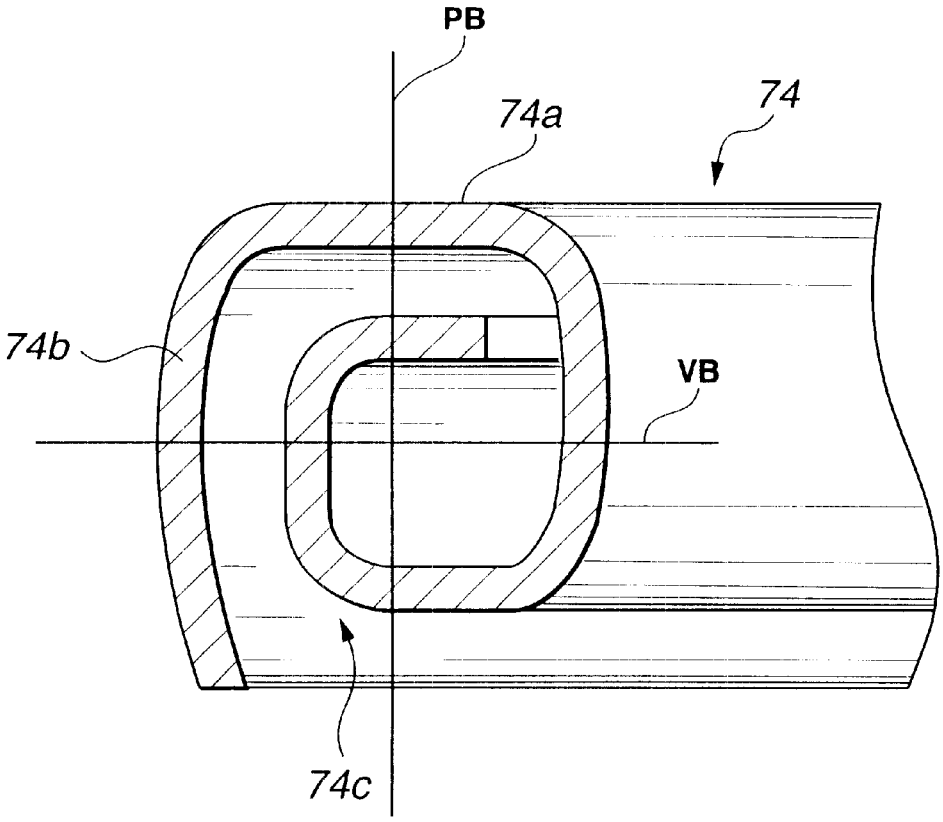
FIG. 8B is an enlarged fragmentary sectional view of the gasket of FIG. 8A.

FIGS. 8A and 8B show a gasket 74 according to a further variant of the present invention. The gasket 74 is made up of an annular strip of a spiral cross section having a radially outer peripheral portion 74*b* upstanding in the direction parallel to the center axis O, which is formed by a radially outer peripheral portion of a metal sheet, an abutment portion 74*a* for contact with the seat portion 1*f* of the spark plug 150, which is formed by bending nearly 90 degrees a portion of the metal sheet extending radially inward from the radially outer peripheral portion of the metal sheet, and a baggy portion 74*c* which is formed by bending a radially inner peripheral portion of the metal sheet in such a manner as to provide three nearly 90-degree bends thereto. As shown in FIG. 8B, the gasket 74 is so shaped as to enable to draw a parallel reference line PB and perpendicular reference line VB which can meet with the above described requirements.

Figure 9A:
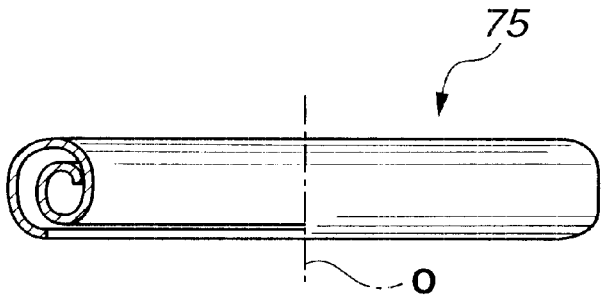
FIG. 9A is a view similar to FIG. 2A but shows a further variant of the gasket of FIG. 1.
Figure 9B:
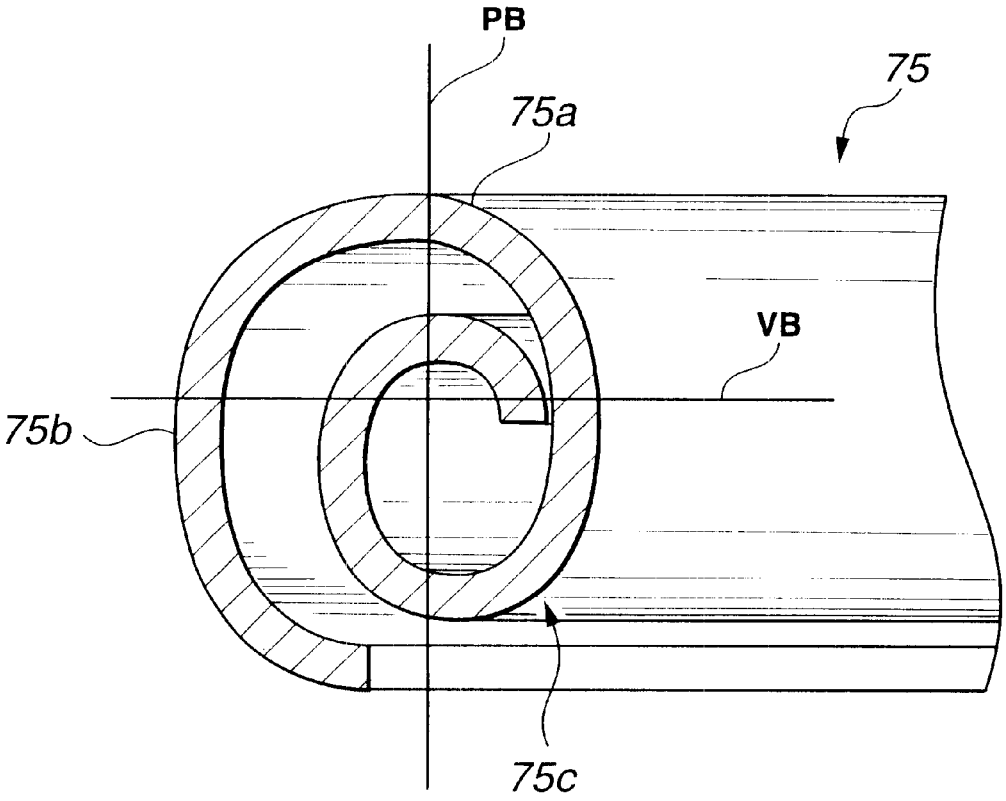
FIG. 9B is an enlarged fragmentary sectional view of the gasket of FIG. 9A.

FIGS. 9A and 9B show a gasket 75 according to a further variant of the present invention. The gasket 75 is made up of an annular strip of a spiral cross section similarly to the gasket 74, i.e., a spiral cross section having a radially outer peripheral portion 75*b*, an abutment portion 75*a* and a baggy portion 75*c*. However, the gasket 75 differs from the gasket 74 in that the cross section has bends which are larger in radius of curvature than those of the gasket 74 so as to have the more rounded shape as a whole. Further, to prevent strong biting or cutting of the gasket 75 into the outer surface of the cylinder head SH around the threaded hole S1, the lower end of the radially outer peripheral portion 75*b* is bent radially inward. As shown in FIG. 9B, the gasket 75 is so shaped as to enable to draw a parallel reference line PB and perpendicular reference line VB which can meet with the above described requirements.

Figure 10A:
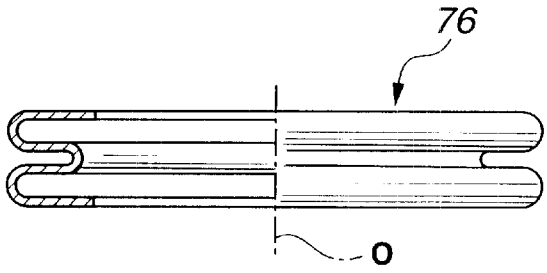
FIG. 10A is a view similar to FIG. 2A but shows a further variant of the gasket of FIG. 1.
Figure 10B:
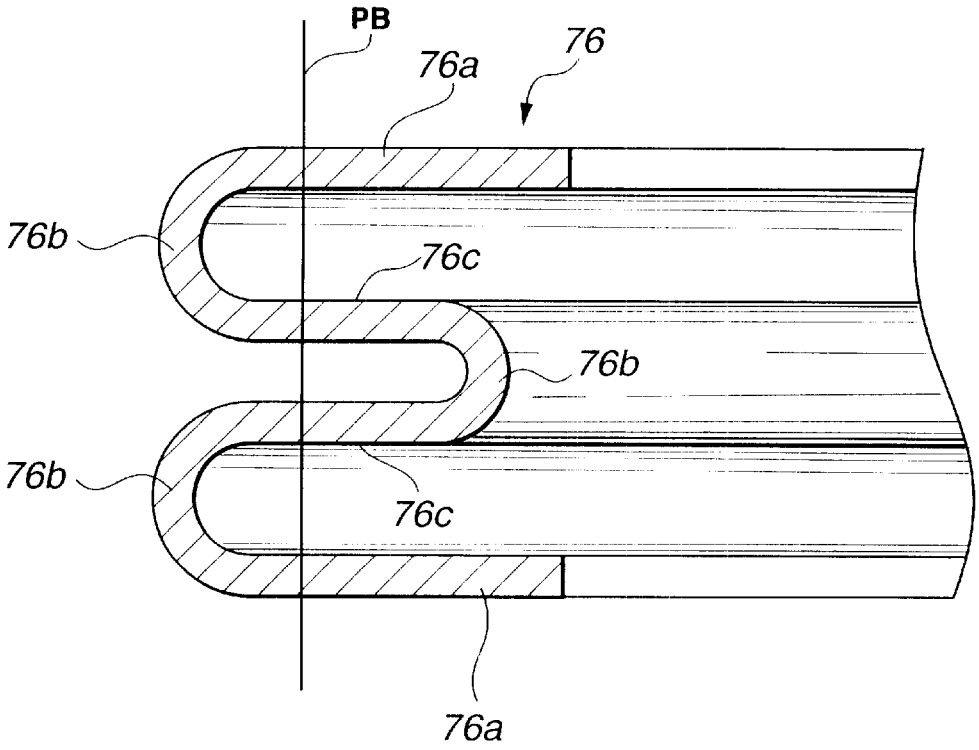
FIG. 10B is an enlarged fragmentary sectional view of the gasket of FIG. 10A.

FIGS. 10A and 10B show a gasket 76 according to a further variant of the present invention. The gasket 76 is made up of an annular strip of a cross section having a first bent portion 76*b* which is formed by a radially intermediate portion of a metal sheet intermediate between the radially inner and outer peripheral portions thereof, and further having a pair of second bent portions 76*b* which are formed by bending the above described radially inner and outer peripheral portions of the metal sheet, reversely to that of the first bent portion 76*b*, whereby to form a pair of parallel, flat abutment portions 76*a* and 76*a* for contact with the seat portion if of the spark plug 150 and the outer surface of the cylinder head SH around the threaded hole S1, respectively. In other words, the gasket 76 has such a cross section including four parallel portions 76*a* and 76*c* which are perpendicular to said center axis O and three bent portions 76*b* each connecting between adjacent two of the parallel portions 76*a* and 76*c* in such a manner that two of said bent portions 76*b* constitute radially outer peripheral walls of said gasket 76. As shown in FIG. 10B, the gasket 76 is so shaped as to enable to draw a parallel reference line PB which can meet with the above described requirements.

Figure 11A:
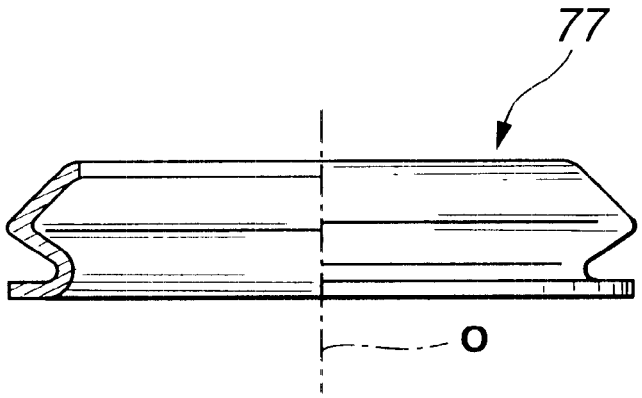
FIG. 11A is a view similar to FIG. 2A but shows a further variant of the gasket of FIG. 1.
Figure 11B:
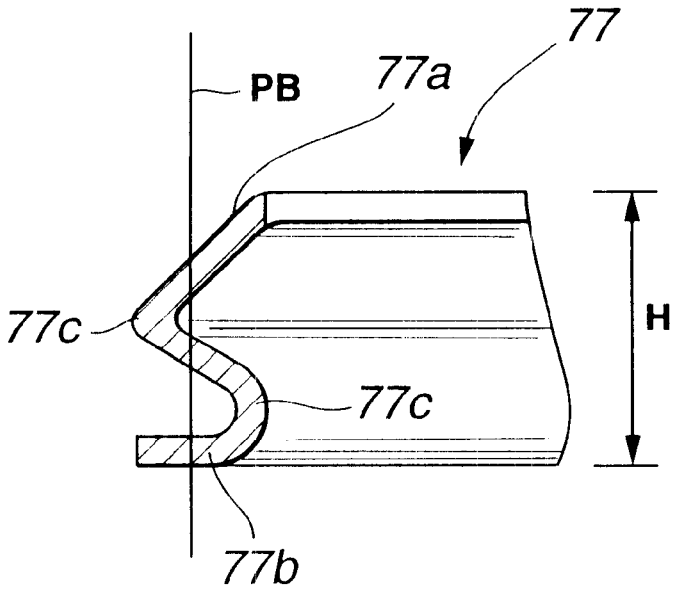
FIG. 11B is an enlarged fragmentary sectional view of the gasket of FIG. 11A.

FIGS. 11A and 11B show a gasket 77 according to a further embodiment of the present invention. The gasket 77 is made up of an annular strip of a nearly S-shaped cross section having a pair of bend portions 77*c* and 77*c* which are formed by bending radially inner and outer peripheral portions of a metal sheet in the opposite directions, respectively, a slanted abutment portion 77*a* for contact with the seat portion 1*f* of the spark plug 150, which is formed by a radially inner peripheral portion of the sheet material, and a flat, horizontal abutment portion 77*b* for contact with the outer surface of the cylinder head SH around the threaded hole S1, which is formed by a radially outer peripheral portion of the metal sheet. The slanted abutment portion 77*a* is adapted to ascend radially inward so that the height H of the gasket 77 is at least 2.5 mm. As shown in FIG. 11B, the gasket 77 is so shaped as to enable to draw a parallel reference line PB which can meet with the above described requirements.

While the invention has been described and shown as above, it is not for the purpose of limitation. Other modifications of the invention shall be apparent to those skilled in the art from the above teachings. For example, the gasket is not limited to use in spark plugs but can be used for other parts with threaded portions, which require a seal between the threaded portions and their attached, threaded holes. For example, the gasket of this invention can be used for automotive electrical equipment parts such as oxygen sensors, HC sensors, NOx sensors or the like gas sensors. The scope of the invention is defined with reference to the following claims.

What is claimed is:

1. A gasket for a threaded element to be screwed into a threaded hole of a support, the threaded element having a threaded portion and an annular seat portion, the gasket being installed on the threaded element and compressed between the seat portion and an outer surface of the support around the threaded hole, when the threaded element is screwed into the threaded hole, to provide a seal between the threaded hole and the seat portion, the gasket being formed from an annular sheet material and in the form of an annular strip of a cross section including a plurality of bent portions, said cross section being made by a plane including a center axis of said gasket and of a such a bent shape as to enable an imaginary reference line which is located on said plane and parallel with said center axis, to cross at least three portions of said cross section, the initial axial size of said gasket being at least 2.5 mm.

2. The gasket according to claim 1, wherein assuming that the pressure P applied to said gasket is expressed by $P=F/\{\pi(R1^2-R2^2)\}$ where R1 is ½ of the initial outer diameter of said gasket, R2 is ½ of the initial inner diameter of said gasket and F is a compressive force applied to said gasket, a variation $\Delta\alpha$ of compressive deformation $\alpha$ of said gasket in response to a variation of said pressure P within the range from 6 to 12 $kgf/mm^2$ is at least 0.5 mm.

3. The gasket according to claim 1, wherein said cross section is so shaped as to enable an imaginary reference line which is located on said plane and perpendicular to said center axis, to cross at least two portions of said cross section.

4. A spark plug comprising:

a center electrode;

an insulator surrounding said center electrode;

a tubular metal shell mounted on said insulator and having a threaded portion;

a ground electrode connected to said shell and spaced apart from said center electrode so as to provide a spark gap therebetween; and a gasket mounted on said metal shell at a location adjacent said threaded portion;

said gasket being formed from an annular sheet material and in the form of an annular strip of a cross section including a plurality of bent portions, said cross section being made by a plane including a center axis of said gasket and of a such a bent shape as to enable an imaginary parallel reference line which is located on said plane and parallel with said center axis, to cross at least three portions of said cross section, the initial axial size of said gasket being at least 2.5 mm.

5. The spark plug according to claim 4, wherein assuming that the pressure P applied to said gasket is expressed by $P=F/\{\pi(R1^2-R^2)\}$ where R1 is ½ of the initial outer diameter of said gasket, R2 is ½ of the initial inner diameter of said gasket and F is a compressive force applied to said gasket, a variation $\Delta\alpha$ of compressive deformation $\alpha$ of said gasket in response to a variation of said pressure P within the range from 6 to 12 kgf/mm$^2$ corresponds to a distance of axial movement of said threaded portion by at least 0.5 pitch.

6. The spark plug according to claim 4, wherein the initial axial size of said gasket is of the length corresponding to at least two pitches of the thread of said threaded portion.

7. The spark plug according to claim 4, wherein assuming that the diameter of said threaded portion is indicated by D(mm), the initial outer diameter of said gasket is equal to or smaller than 1.45D (mm) and indicated by 2R1, and the initial inner diameter of said gasket is equal to or larger than 0.985D (mm) or larger and is indicated by 2R2, a gasket area S which is expressed by $S=\{\pi(R1^2-R2^2)\}$ is within the range from 8D to 10D (mm$^2$).

8. A gasket for installation on a threaded element for providing a seal between a threaded portion of the threaded element and a threaded hole of a support into which the threaded portion is screwed, the gasket being formed from an annular metal sheet and in the form of an annular strip of such a cross section that constitute means for causing the rate of variation of pressure applied to said gasket with respect to a variation of compressive deformation of said gasket, to become more gradual when said pressure is within a range of from 6 to 12 kgf/mm$^2$.

9. The gasket according to claim 8, wherein a variation of said compressive deformation in response to a variation of said pressure within the range from 6 to 12 kgf/mm$^2$ is at least 0.5 mm.

10. The gasket according to claim 8, wherein said cross section is made by a plane including a center axis of said gasket, said cross section including a pair of baggy portions which are arranged side by side along said center axis.

11. The gasket according to claim 8, wherein said cross section is made by a plane including a center axis of said gasket, said cross section including a pair of baggy portions arranged side by side in the radial direction of said gasket.

12. The gasket according to claim 8, wherein said cross section is made by a plane including a center axis of said gasket, said cross section being Z-shaped.

13. The gasket according to claim 8, wherein said cross section is made by a plane including a center axis of said gasket, said cross section being of a spiral shape.

14. The gasket according to claim 8, wherein said cross section is made by a plane including a center axis of said gasket, said cross section including four parallel portions which are perpendicular to said center axis and three bent portions each connecting between adjacent two of said parallel portions in such a manner that two of said bent portions constitute radially outer peripheral walls of said gasket.

15. The gasket according to claim 8, wherein said cross section is made by a plane including a center axis of said gasket, said cross section being S-shaped.

16. The gasket according to claim 8, wherein said cross section is made by a plane including a center axis of said gasket, said cross section being of such a shape as to enable an imaginary reference line which is located on said plane and parallel with said center axis, to cross at least three portions of said cross section.

17. The gasket according to claim 8, wherein said cross section is made by a plane including a center axis of said gasket, said cross section being of such a shape as to enable an imaginary reference line which is located on said plane and perpendicular to said center axis, to cross at least two portions of said cross section.

18. A spark plug comprising:

a center electrode;

an insulator surrounding said center electrode;

a tubular metal shell mounted on said insulator and having a threaded portion;

a ground electrode connected to said shell and spaced apart from said center electrode so as to provide a spark gap therebetween; and a ring-shaped gasket mounted on said metal shell adjacent said threaded portion;

said gasket being formed from a metal sheet and comprising means for causing a variation of compression deformation, which is at least 0.5 mm, in response to a variation of compressive pressure applied thereto, which ranges from 6 to 12 kgf/mm$^2$.

19. The gasket according to claim 1, wherein said imaginary reference line crosses at least four portions of the cross section of the gasket.

* * * * *